US006883449B2

(12) United States Patent
Burrell et al.

(10) Patent No.: US 6,883,449 B2
(45) Date of Patent: Apr. 26, 2005

(54) PROCESS AND COMPONENTS FOR APPLYING APPLIQUES

(75) Inventors: Scott R. Burrell, Phoenix, AZ (US); Steve T. Schlesinger, Phoenix, AZ (US)

(73) Assignee: Fabtex Graphics Inc., Phoenix, AZ (US)

( * ) Notice: Subject to any disclaimer, the term of this patent is extended or adjusted under 35 U.S.C. 154(b) by 52 days.

(21) Appl. No.: 10/458,550

(22) Filed: Jun. 9, 2003

(65) Prior Publication Data

US 2004/0244663 A1 Dec. 9, 2004

(51) Int. Cl.[7] ..... D05C 5/00; D05C 17/00

(52) U.S. Cl. ..... 112/475.19; 112/475.09; 112/439

(58) Field of Search ..... 112/475.18, 475.22, 112/439, 98, 99, 100, 475.09; 156/90, 91, 93; 428/43, 102

(56) References Cited

U.S. PATENT DOCUMENTS 1,646,383 A 10/1927 Becker
2,456,264 A 12/1948 Friedlen
3,794,554 A * 2/1974 Caring ..... 428/43
4,103,634 A 8/1978 Schachter
4,427,472 A 1/1984 Trager
4,646,666 A 3/1987 Burrier
4,828,206 A * 5/1989 Bruno et al. ..... 244/132
5,005,219 A 4/1991 Diaz
5,399,410 A * 3/1995 Urase et al. ..... 428/102
5,537,939 A * 7/1996 Horton ..... 112/475.19
5,758,588 A 6/1998 Orfali
5,832,854 A 11/1998 Lin et al.
6,155,189 A 12/2000 Walner
6,447,131 B1 * 9/2002 Thompson et al. ..... 362/26
6,718,895 B1 * 4/2004 Fortuna ..... 112/475.19

* cited by examiner

*Primary Examiner*—Ismael Izaguirre
(74) *Attorney, Agent, or Firm*—Snell & Wilmer L.L.P.

(57) ABSTRACT

A process and components for applying appliqués to create garments and other items having a vintage appearance is presented. The process utilizes originally cut appliqués having perforations and pull tabs for removing portions of the appliqué to create a resulting design.

17 Claims, 8 Drawing Sheets

PROCESS AND COMPONENTS FOR APPLYING APPLIQUES

FIELD OF INVENTION

The present invention is generally directed to a process for applying appliqués to garments and other materials and to components used in that process. More particularly, the present invention is directed to a process and components for applying an appliqué to a garment to create a vintage look garment by securing the appliqué to a garment and pulling away portions of the appliqué to reveal an underlying stitch outlining the shape of those portions of the appliqué that were pulled apart and separated from the initially secured appliqué.

BACKGROUND OF THE INVENTION

The textile art industry is well established and includes many methods and processes for decorating and personalizing garments and other material items. Some of these methods and processes include applying appliqués, silk-screening, and machining stitching in the shape of various designs directly on garments and other items.

The appliqué method involves placing one layer of fabric over another layer of fabric and securing the first layer of fabric in place. There are many ways to carry out the appliqué method including, but not limited to, basting or sewing the first layer to the second layer, applying an adhesive to the back of the first layer before placement on the second layer, and using heat transfer to transfer an adhesive material to one or more sides of the fabric layers.

A wide variety of designs and materials are available for applying appliqués to other material items, especially garments. One popular design includes alphabetical letters and/or numbers as appliqués that are secured to garments such as letter jackets and sweaters. Sewing of the letter and/or number appliqués to the garments was the typical process used to create these designs. Over a long period of time, these types of appliqués would suffer wear and tear resulting in portions or pieces of the appliqués being torn from the stitched on appliqué. Today, this vintage clothing is very popular and very much in demand. Accordingly, clothing manufacturers are in need of a way to produce clothing having this vintage look without having to go through the actual aging process of the garment.

While it is possible to cut appliqués in the shape of letters and/or numbers having portions or pieces of the letters or numbers missing, and then sewing them to garments to create clothing having a vintage look, the resulting garment does not appear to be authentic. Therefore, in order to meet the demand for vintage look clothing, there is a need for an efficient and effective process for applying appliqués to garments or other materials which provides authentic looking vintage clothing. The present invention provides such a process and components used in that process.

SUMMARY OF THE INVENTION

The present invention is directed to a process and components for applying appliqués to garments or other items comprised of fabric or the like. The present invention is particularly suited for creating vintage look clothing and includes the steps of 1) creating an appliqué having perforations contained therethrough for placement onto a garment, 2) sewing a guide stitch onto the garment which outlines the appliqué so that it can be properly positioned on the garment, 3) placing the appliqué inside the outline created by the guide stitch, 4) sewing the appliqué to the garment without stitching over areas of the appliqué located between perforations that are designed to be pulled apart and separated from the appliqué, and 5) pulling those portions of the appliqué located between perforations away from the appliqué to remove portions of the appliqué thereby revealing the guide stitch so that the resulting garment looks worn and weathered with age.

In one aspect of the invention, the appliqué may include pull away tabs located near the perforations of the appliqué, and comprising part of the appliqué, which can be used to grasp those sections of the appliqué contained between perforations which are designed to be removed in order to create the vintage or aged look of the garment.

The process of the present invention is particularly well suited for creating vintage apparel or fleece by cutting appliqués in the shape of alphanumeric characters. The process of the present invention is also well suited for applying a variety of appliqués in the form of logos, designs, shapes, mascots, characters, symbols, icons, and the like to apparel and other novelty items including, but not limited to, pillows, caps and hats, blankets, stuffed toys, and folding chairs made of fabric.

In an alternative embodiment of the present invention, the guide stitch is sewn to form an outline of the appliqué on a garment or other item without stitching over those areas of the appliqué located between perforations and which are meant to be pulled apart and separated from the appliqué. In this alternative embodiment, a second simulated stitch is sewn onto the garment or other item after sewing the first guide stitch. The second simulated stitch is sewn only on those areas outlining the appliqué which are located between perforations and which are intended to be pulled away and separated from the appliqué. The appliqué is then placed onto the garment or other item within the outline created by the first guide stitch and the second simulated stitch and the appliqué is then sewn to the garment or other item following the same stitch line as the first guide stitch. When portions of the appliqué located between perforations are pulled away and separated from the appliqué, the second simulated stitch appears which outlines that portion of the appliqué that has been removed. In another aspect of this embodiment, the second simulated stitch maybe sewn with gaps in those areas near the perforations of the appliqué to further authenticate a worn or weathered look.

In the process of the present invention, the step of creating an appliqué having perforations contained therethrough is carried out by creating a cutting file that is computer programmed to cut the shape of the appliqué with a cutting tool which is preferably a laser. The cut appliqué may also include pull tabs comprising the appliqué material that are located near the perforations so that portions of the appliqué design can be easily pulled apart. The cut appliqué which includes pull tabs will have a different shape than the intended appliqué design due to the presence of the pull tabs.

The present invention is also directed to the cut appliqués that are produced from the cutting file. As previously stated, these cut appliqués include perforations contained therethrough which create tear away lines and the cut appliqués may also include pull tabs located near the perforations to aid in tearing portions of the appliqué away at the perforations.

Finally, the present invention is also directed to a process for applying appliqués to apparel and materials comprising other items such as pillows, blankets, caps and hats, stuffed toys, folding chairs, and the like, which includes the steps of creating a distorted appliqué and securing the distorted appliqué onto the apparel or other items. The appliqué may be distorted any number of ways including, but not limited to, cutting or tearing away pieces or portions of the appliqué or treating the material of the appliqué with chemicals to wear out portions of the appliqué. Any method of distorting the appliqué so that it results in a worn or weathered look is intended as part of the invention. Means for securing the distorted appliqué to apparel or other material items include, but are not limited to, sewing the distorted appliqué, applying any type of adhesive or wax to the back of the distorted appliqué, and applying any type of protective covering or spray to any portion of the appliqué which enables it to stay secured to apparel or other materials.

All of the exemplary embodiments of the process of the present invention may also be used in multi-layer and multi-fabric applications where multiple layers of materials and/or appliqués are utilized to create a variety of vintage type looks on apparel and other novelty items.

BRIEF DESCRIPTION OF THE DRAWINGS

The present invention will hereinafter be described in conjunction with the appended drawing figures, wherein like numerals denote like elements, and.

DETAILED DESCRIPTION

The present invention is directed to a process for applying appliqués to garments and other materials, including materials used to create novelty items such as blankets, pillows, caps and hats, stuffed toys, folding chairs, and the like, to create a garment or material having a worn and weathered look. For ease of description, exemplary embodiments of the present invention will be described with reference to applying appliqués to garments to create garments having a vintage look. However, it will be understood by those skilled in the art that vast numbers of various types of materials may be used in accordance with the present invention to apply appliqués to a variety of items such as novelty items including, but not limited to, pillows, blankets, caps and hats, stuffed toys, folding chairs, and the like.

One exemplary embodiment of the process of the present invention for applying appliqués to garments to create vintage look clothing includes the steps of 1) creating an appliqué for placement on a garment where the appliqué has perforations through the fabric of the appliqué and pull tabs located near the perforations, 2) sewing a first guide stitch onto the garment which creates an outline of the appliqué to facilitate placement of the appliqué on the garment, 3) sewing a second simulated stitch located near where the perforations of the appliqué would be once secured to the garment which fills various gaps in the outline created by the first guide stitch, 5) securing the appliqué to the garment without sewing over areas of the appliqué between perforations which are adjacent to the pull tabs of the appliqué, and 6) pulling on the pull tabs of the appliqué to tear away and separate portions of the appliqué located between perforations in the appliqué. It should be noted that some or all of the simulated second stitch will be revealed upon tearing away portions of the appliqué.

Figure 1:
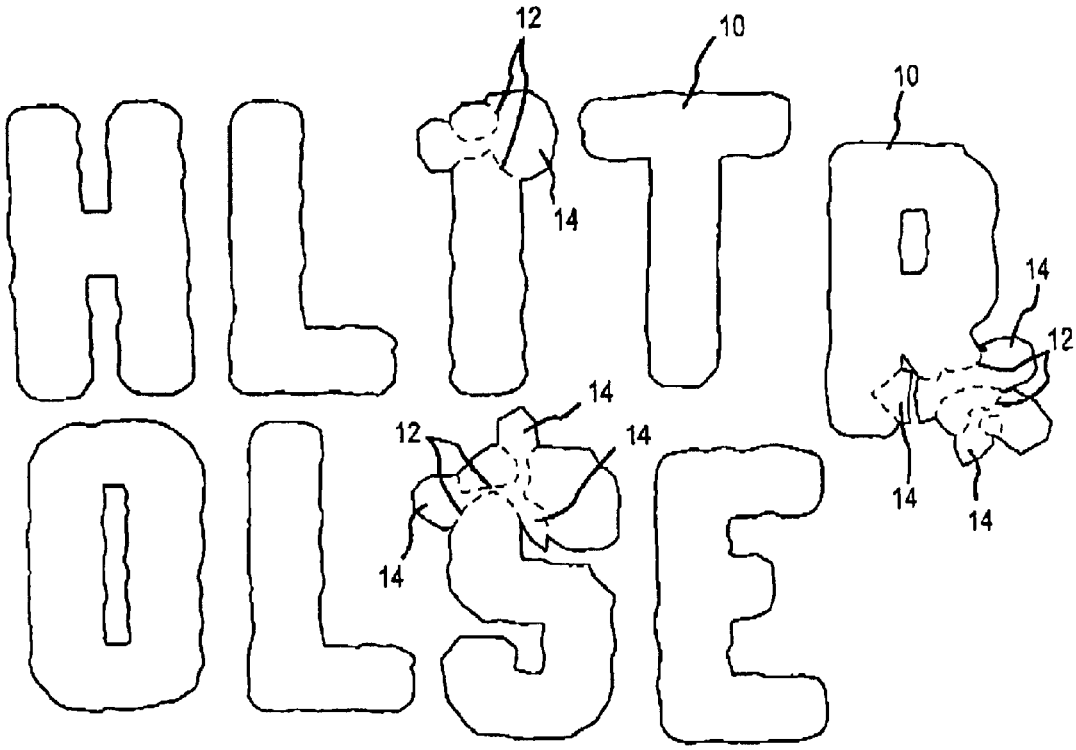
FIG. 1 shows cut out appliqués in the form of alphabetical letters with perforations in the appliqués shown by dashed lines and pull tabs located near the perforations.

FIG. 1 shows alphabetical letter appliqués 10 cut from a material used for making the appliqués in accordance with the present invention. In order to create an end product having a worn and weathered look, some of the appliqués 10 include perforations 12, shown by dashed lines, and pull tabs 14 located near the perforations. Pull tabs 14 comprise extensions of the alphabetical letters, which enable an individual to easily grasp them and pull on them in various directions in relation to the alphabetical letters. Pull tabs 14 are pulled away from the alphabetical letter appliqués 10 after letter appliqués 10 are secured to a garment. This results in gaps contained within some of the letter appliqués 10 to simulate the look of a worn and weathered garment.

The fabric used to create letter appliqués 10 preferably comprises a felt material or the like which can be easily torn and which presents an authentic looking worn effect when torn away at the perforations 12 contained in the material. The alphabetical letter appliqués 10 are preferably cut from a material using a carbon dioxide laser such as that manufactured by CADCAM in the United Kingdom which has been computer programmed to cut the shapes of letter appliqués 10 and the perforations 12 contained within them. It will be understood by those skilled in the art that other cutting tools and cutting methods may be employed to create the letter appliqués 10 including, but nor limited to, water jet machines, hydraulic stamping presses, knife cutting machines, and ordinary scissors. However, using these alternative cutting tools and methods could prove to be difficult depending upon the intricacy of the appliqué's design.

The present invention is also directed to the cut out appliqués themselves in that their perforations and pull tab components used in the process of the present invention enable the creation of a garment having an authentic worn and weathered appearance. More specifically, the present invention is directed to an appliqué having perforations contained therein for removing portions of the appliqué. The appliqué of the present invention may also include pull tabs located near the perforations to enable tearing away portions of the appliqué located between perforations. The pull tabs preferably comprise extensions of the appliqués design and are formed continuously with, and as part of, the originally cut appliqué.

Alphanumeric characters such as letters and numbers are popular design choices for appliqués, especially those used for creating vintage look clothing. Moreover, in the event that numbers and letters are used in combination to create letter sweaters, letter jackets, and sweatshirts having a vintage appearance, such combination of letters and/or numbers may be packaged and distributed together as one unit. Other sets of appliqué pieces including appliqués in the form of logos, designs, shapes, mascots, characters, symbols, icons, and the like may also be packaged together and distributed as sets. As previously stated, these packaged units or sets may be applied to garments as well as a variety of novelty items that are comprised of a material to which the appliqué may be applied.

Figure 2:
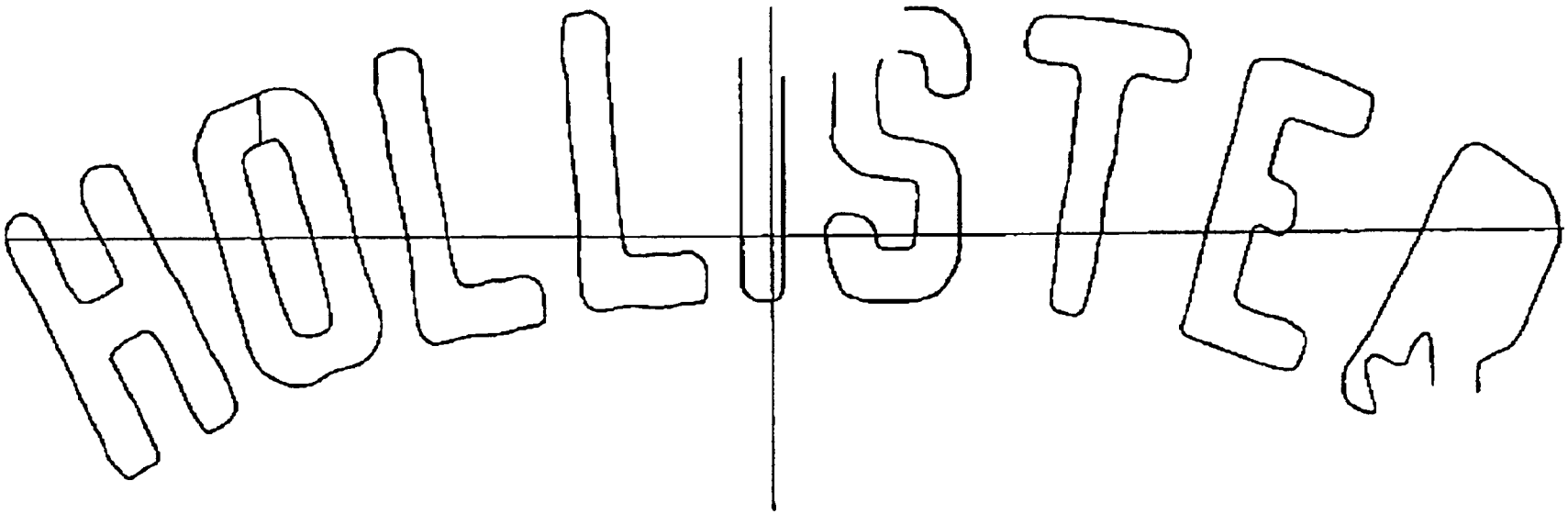
FIG. 2 is a schematic in accordance with one exemplary embodiment of the invention showing the stitch pattern created after sewing the first guide stitch onto a garment.

Turning now to the second step in the exemplary process of the present invention, a guide stitch is sewn onto a garment outlining the shape of the appliqué except in those areas of the appliqué having perforations for removing portions of the appliqué. These areas are not covered by the guide stitch. FIG. 2 is a schematic showing the stitch pattern created on the garment after sewing the first guide stitch. The stitching pattern for the first guide stitch is preferably computer programmed for embroidery sewing machines such as that manufactured by Tajima located in Japan to automatically sew the guide stitch pattern.

Figure 3:
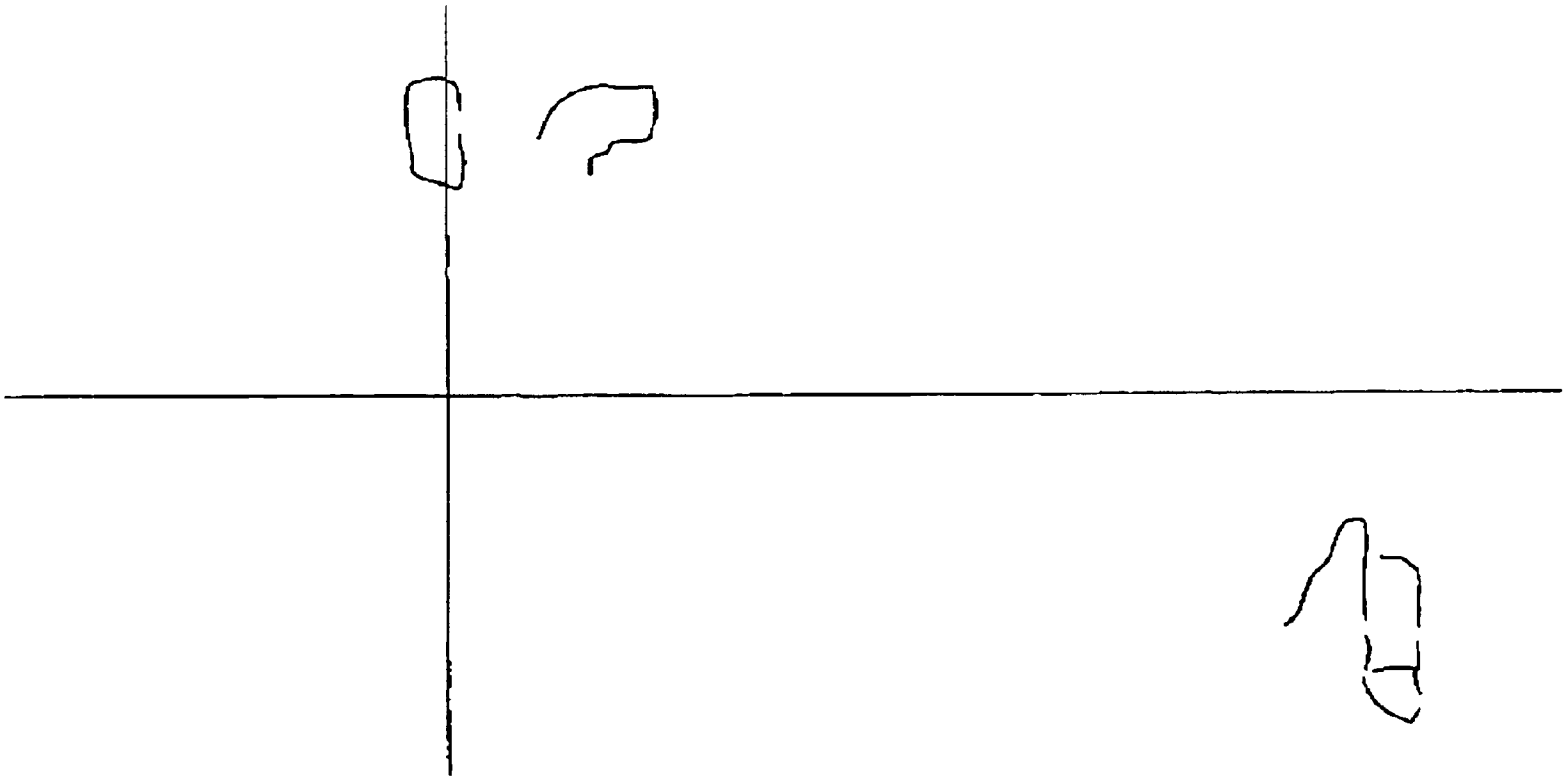
FIG. 3 is a schematic in accordance with the exemplary embodiment of the present invention shown in FIG. 2 showing the stitch pattern created after sewing the second simulated stitch onto the garment.

A second stimulated stitch is sewn on the garment in the third step of the exemplary process of the present invention. The second simulated stitch is sewn in areas outlining where the appliqué would be placed on the garment in those places where the first guide stitch was not sewn. Therefore, after sewing the first guide stitch and the second simulated stitch onto the garment, a complete outline of the appliqué design is shown stitched on the garment in that position where the appliqué design should be placed. FIG. 3 is a schematic showing the stitch pattern created on the garment after sewing the second simulated stitch. It will be understood by those skilled in the art that although the various stitches are preferably sewn with a computerized embroidery sewing machine, the stitches may be sewn with ordinary sewing machines, variations of ordinary sewing machines, or by hand.

In the next step of the process of the present invention, the cut out appliqués shown in FIG. 1 are positioned on the garment according to the outline of the cut out appliqués that were created by sewing the first guide stitch and second simulated stitch. The cut out appliqués are then sewn onto the garment. Prior to sewing, the cut out appliqués may be secured to the garment by applying an adhesive or the like to the back of the appliqués such as Super 77 manufactured by 3M located in St. Paul, Minn., KK100 manufactured by Gunold located in Germany, and a spray adhesive manufactured by Crown Embroidery Supplies located in Los Angeles, Calif.

Figure 4:
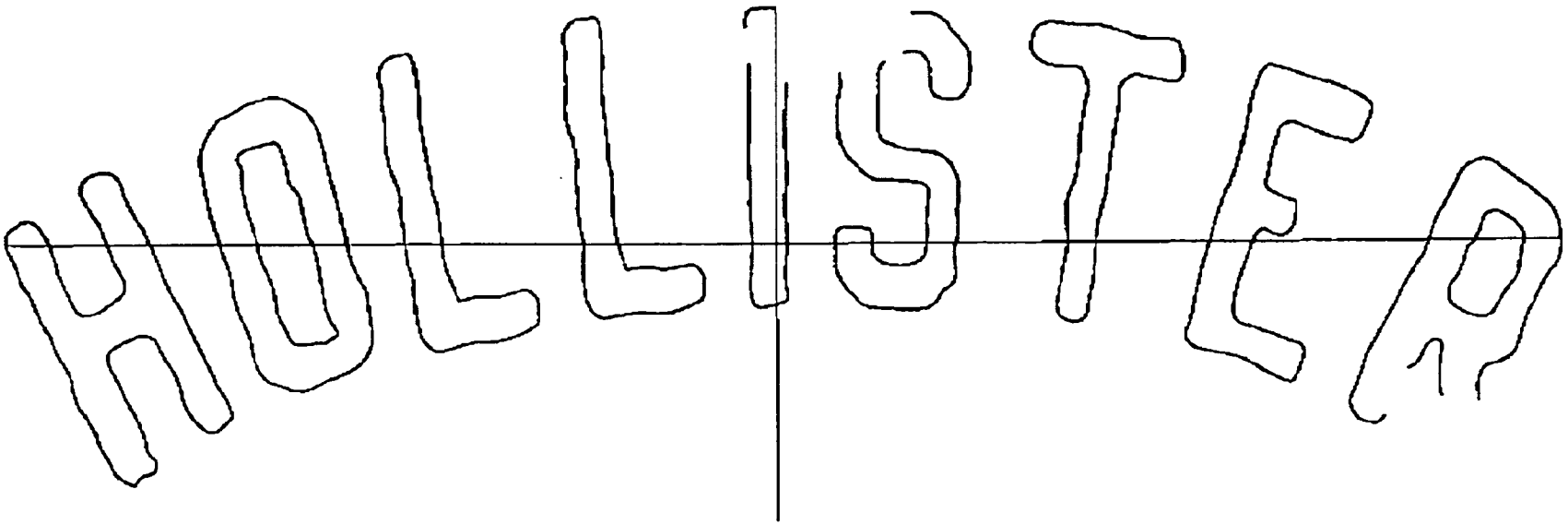
FIG. 4 is a schematic in accordance with the exemplary embodiment of the present invention shown in FIGS. 2 and 3 showing the stitch pattern created after sewing the cut our appliqués shown in FIG. 1 to a garment with a final tacking stitch.

FIG. 4 is a schematic showing the stitch pattern created after sewing the cut out appliqués shown in FIG. 1 onto the garment with a final tacking stitch. The tacking stitch is not sewn over areas contained between perforations in the appliqués that have pull tabs because these areas of the appliqués are intended to be torn away from the appliqués to create a garment having a worn and weathered appearance.

After sewing the cut out appliqués to the garment with the final tacking stitch, the pull tabs on the cut out appliqués are pulled in various directions to tear the appliqués at their perforations thereby separating and pulling away portions of the appliqués. Removing these portions of the appliqués reveals the underlying second simulated stitch and this stitch, in addition to the frayed and torn edges contained around the missing portions of the appliqués creates a garment having a worn and weathered appearance.

Figure 5:
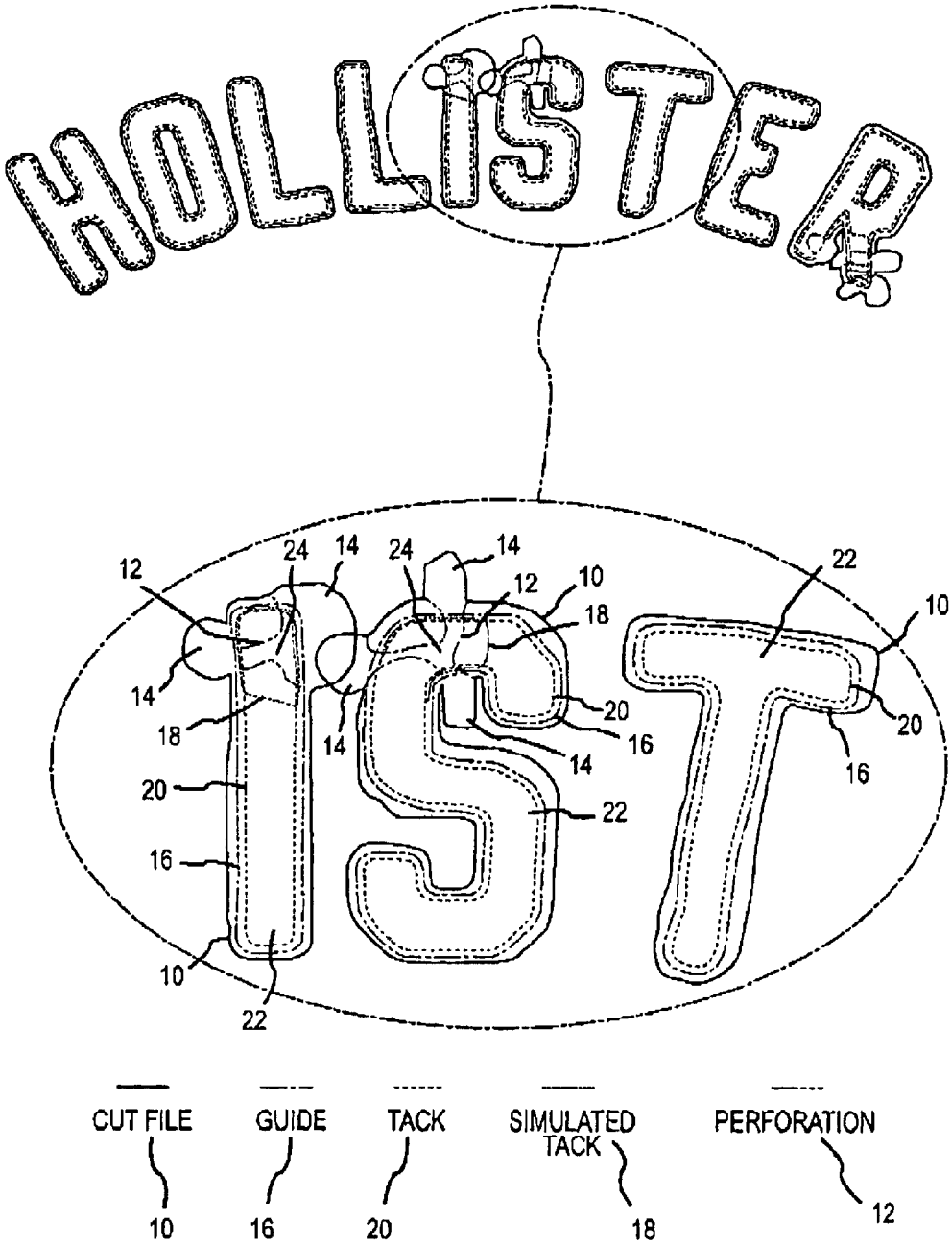
FIG. 5 is a schematic in accordance with the exemplary embodiment of the present invention shown in FIGS. 1–4 with a magnifies view showing placement of the guide stitch, simulated stitch, cut out appliqués, and final talking stitch on the garment with portions of the appliqués shown torn away by pulling on the pull tabs of the appliqués.

Placement of the first guide stitch 16, second simulated stitch 18, originally cut out appliqués 10 with their perforations 12 and pull tabs 14, and final tacking stitch 20 are all shown together in FIG. 5. FIG. 5 also shows the resulting appliqué design 22 after tearing away and removing portions of the originally cut appliqués 10 by pulling on the pull tabs 14 of the originally cut appliqués 10. Open areas contained in cut out appliqués 10 where portions of cut out appliqués 10 have been torn away are shown by reference numeral 24.

In accordance with another exemplary embodiment of the process of the present invention, the guide stitch may be computer programmed to have a pattern which comprises the entire outline of the resulting appliqué design. The originally cut appliqués are then positioned on the garment within the outline created by the guide stitch and sewn to the garment with a final tacking stitch. The final tacking stitch is not sewn over areas contained between perforations in the originally cut appliqués that have pull tabs because these areas of the appliqués are intended to be torn away from the appliqués to create a garment having a worn and weathered appearance. After sewing the originally cut appliqués to the garment, the pull tabs of the appliqués are pulled in order to tear the appliqués at the areas of their perforations and remove portions of the appliqués. This second exemplary embodiment does not include the step of creating a second simulated stitch as described in reference to the first exemplary embodiment.

Figure 6:
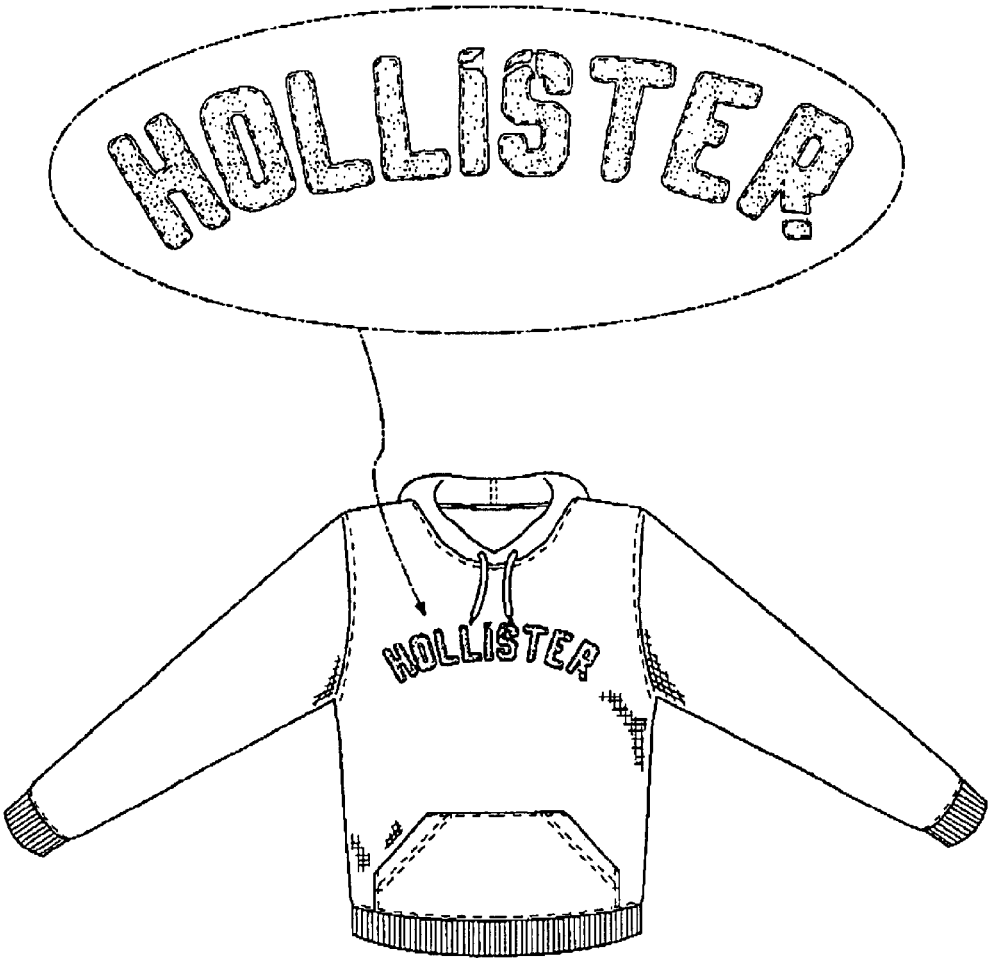
FIG. 6 is a schematic showing an exemplary appliqué applied to a sweatshirt to create a worn and weathered look, which was made in accordance with the exemplary process of the present invention shown in FIGS. 1–5.

FIG. 6 is a schematic showing an exemplary sweatshirt made in accordance with the process of the present invention to simulate a worn and weathered appearance.

Figure 7:
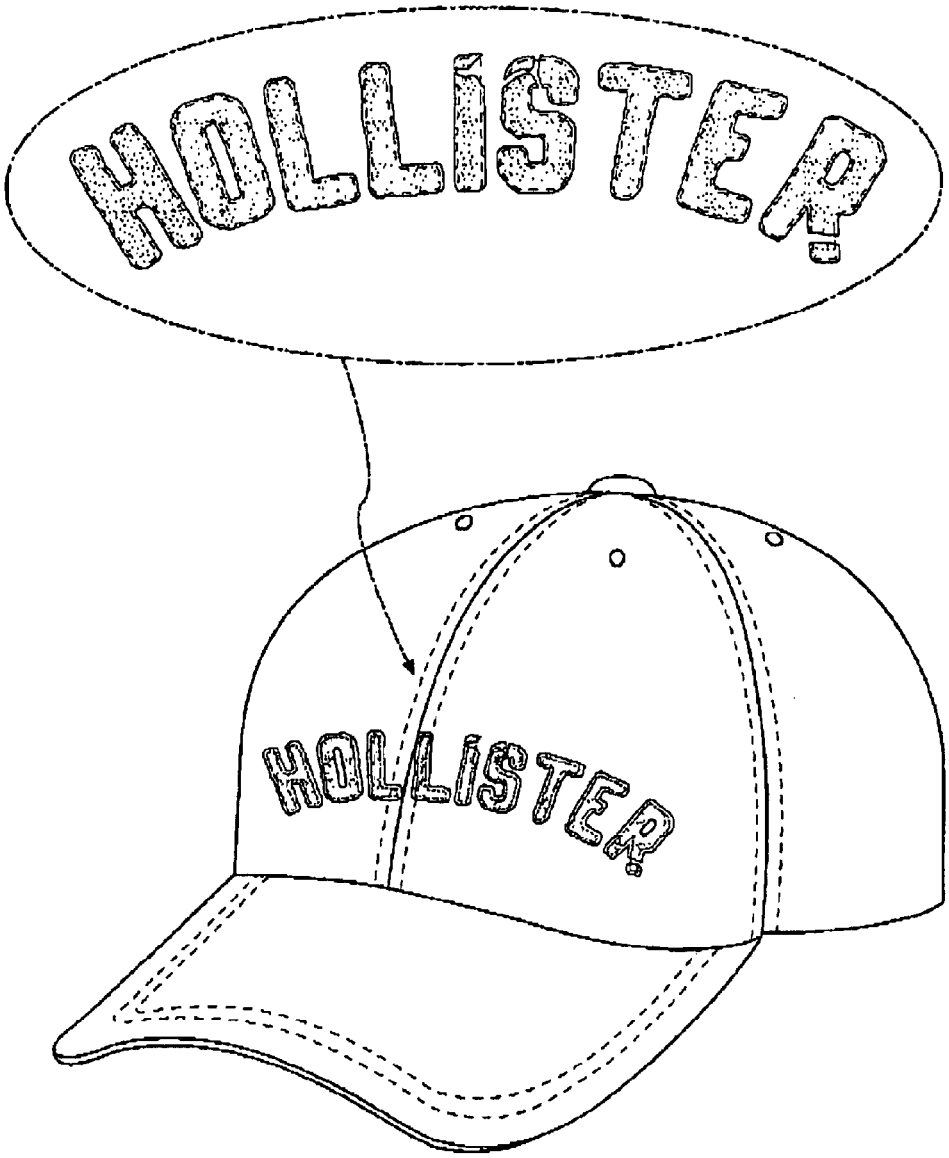
FIG. 7 is a schematic showing an exemplary appliqué applied to a baseball cap to create a worn and weathered look, which was made in accordance with the exemplary process of the present invention shown in FIGS. 1–5.

FIG. 7 is a schematic showing an exemplary baseball cap made in accordance with the process of the present invention to simulate a worn and weathered appearance.

Figure 8:
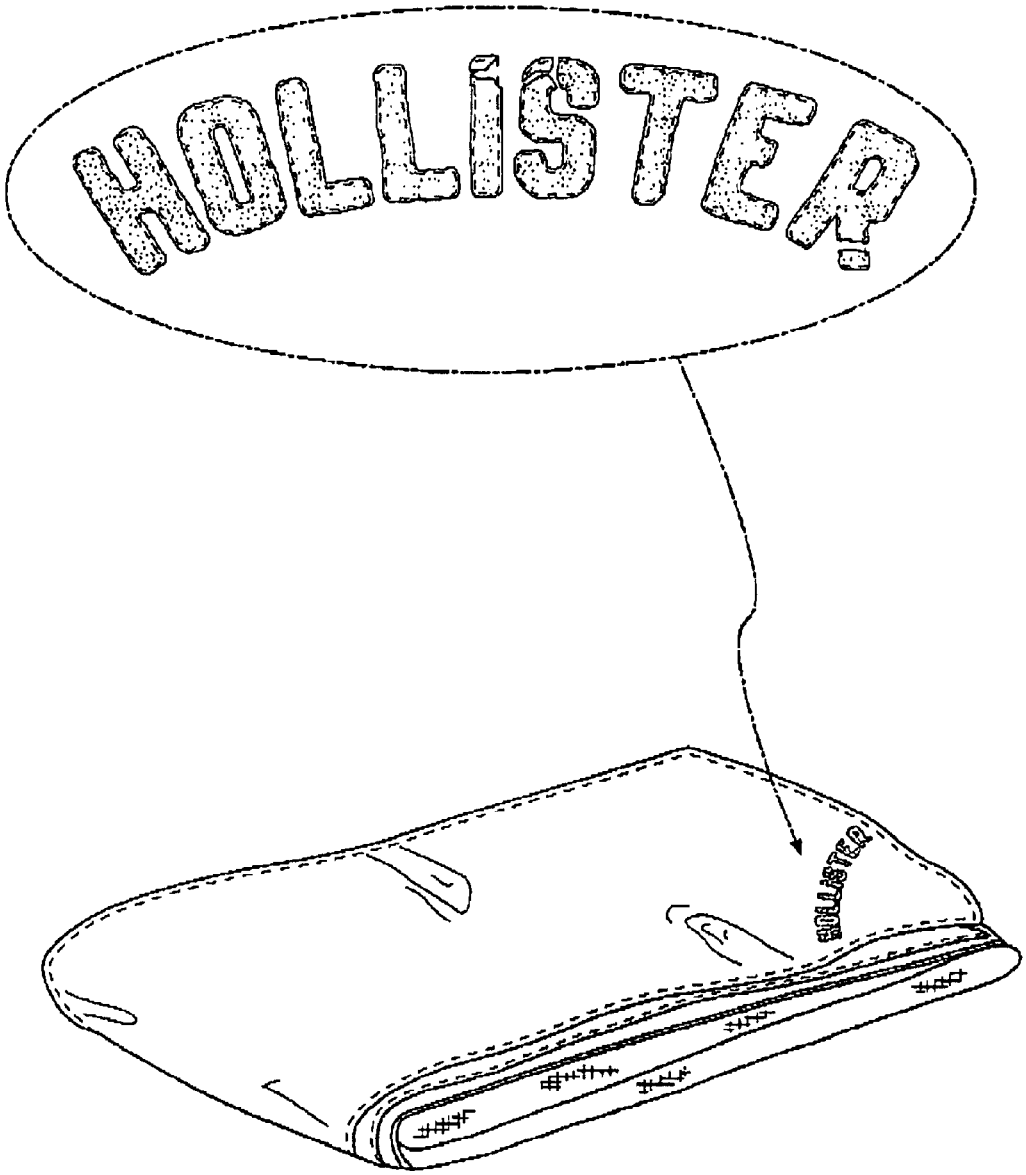
FIG. 8 is a schematic showing an exemplary appliqué applied to a blanket to create a worn and weathered look, which was made in accordance with the exemplary process of the present invention shown in FIGS. 1–5.

FIG. 8 is a schematic showing an exemplary blanket made in accordance with the process of the present invention to simulate a worn and weathered appearance.

It will be understood that the foregoing description is of preferred exemplary embodiments of the invention and that the invention is not limited to the specific forms shown or described herein. Various modifications may be made in the process steps of the present invention, such as the computer programmed stitch patterns for various stitches used in the process, without departing from the scope of the invention as expressed in the appended claims.

We claim:

1. A process for applying at least one appliqué to a material comprising the steps of:

(a) creating at least one appliqué having perforations for tearing away portions of the appliqué;

(b) sewing a first guide stitch on a material to show placement of the appliqué;

(c) placing the appliqué within an area outlined by the guide stitch;

(d) sewing the appliqué to the material with a final tacking stitch without stitching over areas located between the perforations which are designed to be torn away from the appliqué; and (e) pulling the appliqué near its perforations to separate and remove portions of the appliqué.

2. The process of claim 1 wherein said material comprises at least one of a garment, a blanket, a pillow, a cap, a hat, a stuffed toy, and a folding chair.

3. The process of claim 1 wherein said step of creating at least one appliqué having perforations comprises cutting a piece of appliqué material into a desired shape with perforations cut into the desired shape.

4. The process of claim 2 wherein said step of creating at least one appliqué having perforations further comprises the step of cutting the desired shape so that pull tabs are created near the area of the perforations.

5. The process of claim 4 wherein said appliqué comprises one or more alphanumeric characters.

6. The process of claim 5 wherein the step of pulling the appliqué near its perforations results in a worn and weathered looking garment wherein the guide stitch shows in those areas where portions of the alphanumeric characters are separated and pulled apart.

7. The process of claim 1 wherein said appliqué comprises at least one of an alphanumeric character, a design, a logo, a shape, a mascot, a character, a symbol, and an icon.

8. The process of claim 1 wherein the step of sewing a first guide stitch comprises the step of stitching an outline of the appliqué's shape on the material except in areas of the appliqué located between perforations where portions of the appliqué are removed by pulling apart the appliqué near the perforations.

9. The process of claim 8 further comprising the step of sewing a second simulated stitch between perforations in those areas where the appliqué is pulled apart after sewing the final tack down stitch.

10. The process of claim 1 wherein the step of placing the appliqué within the guide stitch comprises the step of applying an adhesive to a back of the appliqué before positioning the appliqué within the guide stitch located on the material.

11. The process of claim 1 wherein the step of creating at least one appliqué having perforations comprises the step of using a cutting tool that is programmed to cut a shape and size of the appliqué and perforations contained in the appliqué using computer software.

12. The process of claim 11 wherein the cutting tool comprises at least one of a laser, a water jet, a hydraulic stamping press, a knife cutting machine, and a scissors.

13. A method for creating vintage look clothing by applying an appliqué to a garment comprising the steps of:

a) cutting at least one appliqué having a plurality of perforations contained therein;

b) sewing a first guide stitch on a garment to outline a position on the garment for placement of the appliqué by sewing an outline of the appliqué onto the garment except between areas where perforated tear away portions of the appliqué would be located after securing the appliqué onto the garment;

c) sewing a second simulated stitch onto the garment in areas defining an outline of the appliqué where the first guide stitch is not shown;

d) placing the appliqué within the outline on the garment formed by the first guide stitch and second simulated stitch;

e) sewing the appliqué to the garment without stitching between the perforations in areas near the perforations where portions of the appliqué will be pulled away from the appliqué; and f) pulling the portions of the appliqué not sewn down to the garment apart from the appliqué near the perforations to separate those portions from the appliqué.

14. The method of claim 13 wherein the step of cutting at least one appliqué having a plurality of perforations comprises the step of creating pull tabs near the plurality of perforations as part of the appliqué.

15. The method of claim 13 wherein said appliqué comprises one or more alphanumeric characters.

16. The method of claim 13 wherein said step of cutting at least one appliqué having perforations comprises the step of cutting a material into a desired shape using at least one of a laser, a water jet, a hydraulic stamping press, a knife cutting machine, and a scissors, wherein the desired shape includes perforations contained therethrough.

17. The method of claim 13 wherein said step of placing the appliqué within the outline on the garment comprises applying an adhesive to a back of the appliqué before placing it on the garment.

* * * * *